US006872426B2

(12) United States Patent
Perry et al.

(10) Patent No.: US 6,872,426 B2
(45) Date of Patent: Mar. 29, 2005

(54) SUBSTRATE WITH RECESSED SURFACE PORTION

(75) Inventors: Philip G. Perry, Webster, NY (US); Linnette Perales Rivera, Webster, NY (US); Charles J. Urso, III, Webster, NY (US)

(73) Assignee: Xerox Corporation, Stamford, CT (US)

( * ) Notice: Subject to any disclaimer, the term of this patent is extended or adjusted under 35 U.S.C. 154(b) by 460 days.

(21) Appl. No.: 10/020,990

(22) Filed: Dec. 19, 2001

(65) Prior Publication Data

US 2003/0113468 A1 Jun. 19, 2003

(51) Int. Cl.[7] ..... B05C 3/09; B05C 13/02; G03G 5/05

(52) U.S. Cl. ..... 427/430.1

(58) Field of Search ..... 427/11, 75, 231, 427/258, 282, 430.1

(56) References Cited

U.S. PATENT DOCUMENTS

| | | | | |
|---|---|---|---|---|
| 4,627,808 A | * | 12/1986 | Hughes | 425/270 |
| 5,385,759 A | | 1/1995 | Crump et al. | 427/430.1 |
| 5,578,410 A | | 11/1996 | Petropoulos et al. | 430/133 |
| 5,633,046 A | | 5/1997 | Petropoulos et al. | 427/430.1 |
| 5,683,742 A | | 11/1997 | Herbert et al. | 427/11 |
| 6,132,810 A | | 10/2000 | Swain et al. | 427/430.1 |
| 2003/0113469 A1 | | 6/2003 | Pan et al. | 427/430.1 |
| 2003/0113470 A1 | | 6/2003 | Pan et al. | 427/430.1 |
| 2003/0113471 A1 | | 6/2003 | Pan et al. | 427/430.1 |

FOREIGN PATENT DOCUMENTS

| | | | | |
|---|---|---|---|---|
| JP | 2003145001 A | * | 5/2003 | B05C/3/09 |

* cited by examiner

*Primary Examiner*—Sandra M. Nolan-Rayford
(74) *Attorney, Agent, or Firm*—Zosan S. Soong

(57) ABSTRACT

An apparatus including: (a) a substrate including a deposition region and an optional uncoated region, wherein the deposition region includes a level intermediate region disposed between a first end region and a second end region, wherein the first end region includes a first recessed surface portion that increases the surface area of the first end region, wherein the first recessed surface portion is recessed below the level intermediate region, wherein the surface area of the first end region is greater by at least about 5% than the surface area of a hypothetical level first end region; and (b) a dip coated layer over the entire deposition region.

7 Claims, 5 Drawing Sheets

SUBSTRATE WITH RECESSED SURFACE PORTION

BACKGROUND OF THE INVENTION

When a photoreceptor is dip coated, the layer thickness increases slowly to a target value after the takeup speed reaches a constant value. The resulting non-uniformity in layer thickness is called "sloping." "Sloping" of the deposited layer over the imaging area of the photoreceptor is undesirable since it can degrade the performance of the photoreceptor. To prevent the deposited layer from exhibiting "sloping" in the imaging area, one can use a longer substrate to provide a longer non-imaging area so that the "sloping" of the deposited layer occurs only in the non-imaging area while the deposited layer exhibits relatively uniform thickness in the imaging area. However, a longer substrate and a longer non-imaging area increase costs since more materials have to be used in the substrate and the deposited layer or layers. Thus, there is a need, which the present invention addresses, for new methods to eliminate or reduce the above described problem.

Coating methods and apparatus are described in Petropoulos et al., U.S. Pat. No. 5,633,046; Herbert et al., U.S. Pat. No. 5,683,742; Swain et al., U.S. Pat. No. 6,132,810; Petropoulos et al., U.S. Pat. No. 5,578,410; and Crump et al., U.S. Pat. No. 5,385,759.

SUMMARY OF THE INVENTION

The present invention is accomplished in embodiments by providing an apparatus comprising:

(a) a substrate including a deposition region and an optional uncoated region, wherein the deposition region includes a level intermediate region disposed between a first end region and a second end region, wherein the first end region includes a first recessed surface portion that increases the surface area of the first end region, wherein the first recessed surface portion is recessed below the level intermediate region, wherein the surface area of the first end region is greater by at least about 5% than the surface area of a hypothetical level first end region; and (b) a dip coated layer over the entire deposition region.

There is also provided in embodiments a coating method comprising:

(a) providing a substrate including a deposition region and an optional uncoated region, wherein the deposition region includes a level intermediate region disposed between a first end region and a second end region, wherein the first end region includes a first recessed surface portion that increases the surface area of the first end region, wherein the first recessed surface portion is recessed below the level intermediate region, wherein the surface area of the first end region is greater by at least about 5% than the surface area of a hypothetical level first end region;

(b) dip coating a layer of a coating solution over the first end region, the intermediate region, and the second end region in the recited sequence.

BRIEF DESCRIPTION OF THE DRAWINGS

Unless otherwise noted, the same reference numeral in different Figures refers to the same or similar feature.

DETAILED DESCRIPTION

Figure 1:
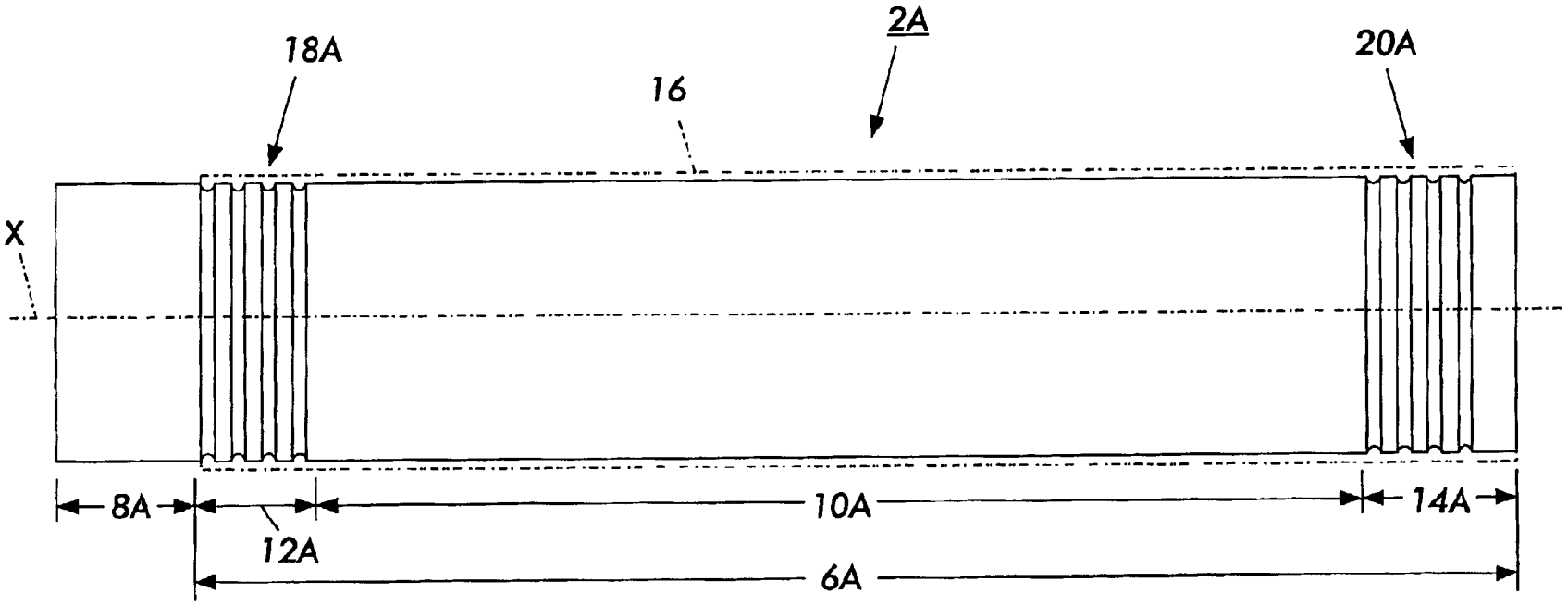
FIG. 1 is an elevational view of a first embodiment of the present coated substrate.

As seen in the Figures, the substrate (2A, 2B, 2C, 2D), having a longitudinal axis X, defines on its outer surface a deposition region (6A, 6B, 6C, 6D) and an optional uncoated region (8A, 8B, 8C), wherein the deposition region includes an intermediate region (10A, 10B, 10C, 10D) disposed between a first end region (12A, 12B, 12C, 12D) and a second end region (14A, 14B, 14C, 14D). In embodiments where the substrate is part of an electrostatographic imaging member (e.g., a photoreceptor), one or more of the first end region, the second end region, and the optionally uncoated region may correspond to a non-imaging area of the imaging member, whereas the imaging area of the imaging member includes at least the intermediate region and optionally one or both of the first end region and the second end region. In FIG. 1, a dip coated layer 16 is formed over the entire deposition region.

In FIG. 1, the first end region 12A includes a first recessed surface portion 18A which can be one or more grooves. The number of grooves may range for example from 1 to 10. The groove or grooves may have a depth ranging for example from about 10 micrometers to about 500 micrometers, and particularly about one-half the substrate wall thickness, and a width (i.e., along the longitudinal axis) ranging for example from about 20 micrometers to about 5 mm. Groove depth may be greater than the values recited herein for solid substrates or substrates with a thicker wall thickness. The groove or grooves can have any suitable length such as circumferential around the outer dimension of the first end region as depicted in FIG. 1, or less than circumferential such as a length ranging for example from about 5 mm to about 5 cm. The groove or grooves may be arranged in any suitable manner such as a spiral, regular or irregular groove spacing, and a parallel or non-parallel groove arrangement.

The second end region 14A optionally includes a second recessed surface portion 20A similar or dissimilar to the first recessed surface portion. In FIG. 1, the second recessed surface portion 20A is depicted as a plurality of grooves similar to the grooves of the first recessed surface portion.

Figure 2:
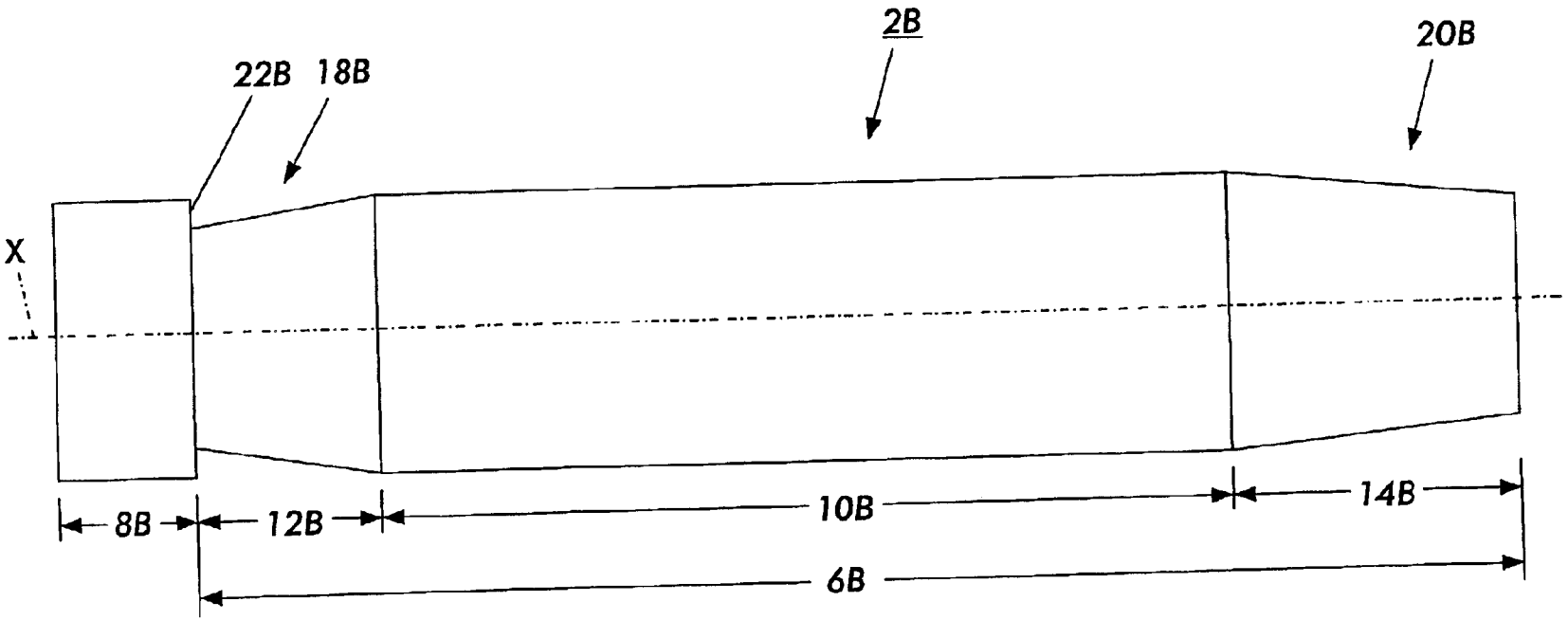
FIG. 2 is an elevational view of a second embodiment of the substrate useful in the present invention.
Figure 3:
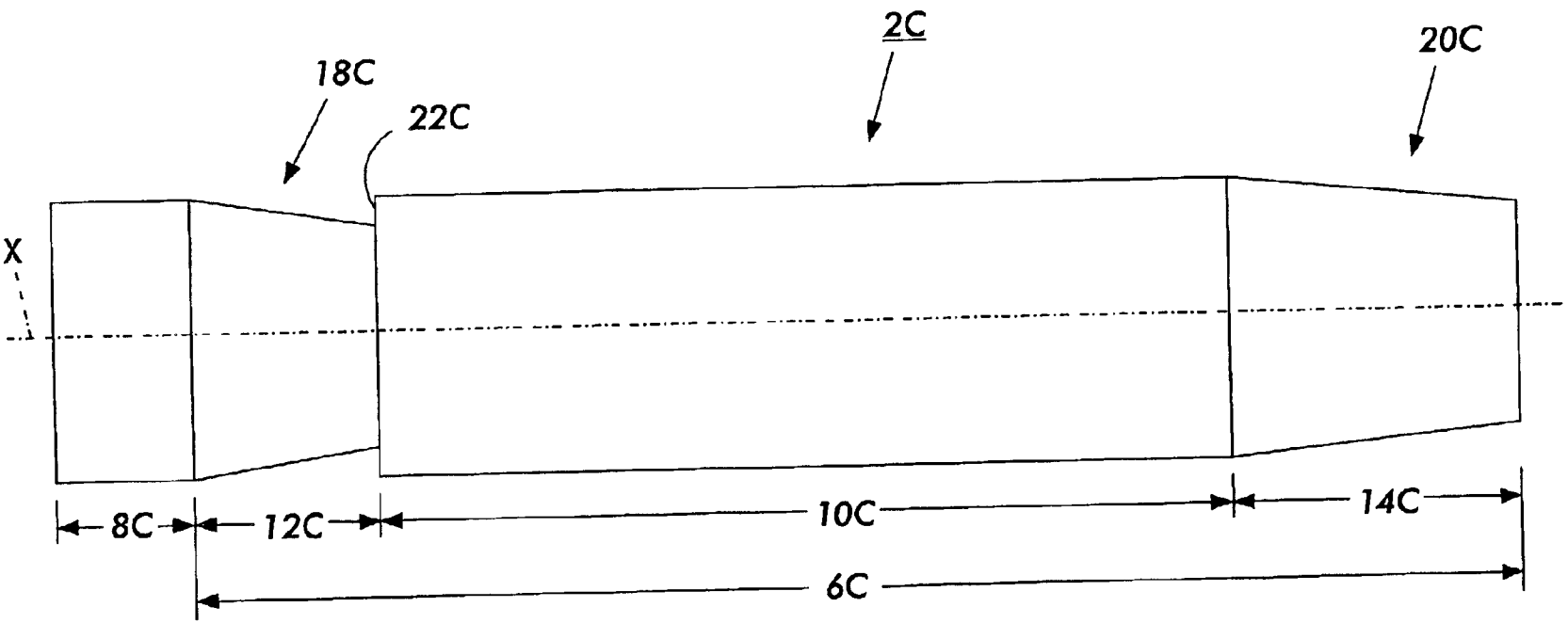
FIG. 3 is an elevational view of a third embodiment of the substrate useful in the present invention.

In FIGS. 2–3, the first recessed surface portion (18B, 18C) and the optional second recessed surface portion (20B, 20C) are depicted as a tapered surface, with the vertical surface (22B, 22C) considered part of the first recessed surface portion. FIGS. 2 and 3 are similar except that the tapered surfaces of the first recessed surface portion (18B, 18C) are recessed in different directions. The tapered surface can form an angle ranging for example from less than about 1 degree to about 45 degrees with the longitudinal axis.

Figure 4:
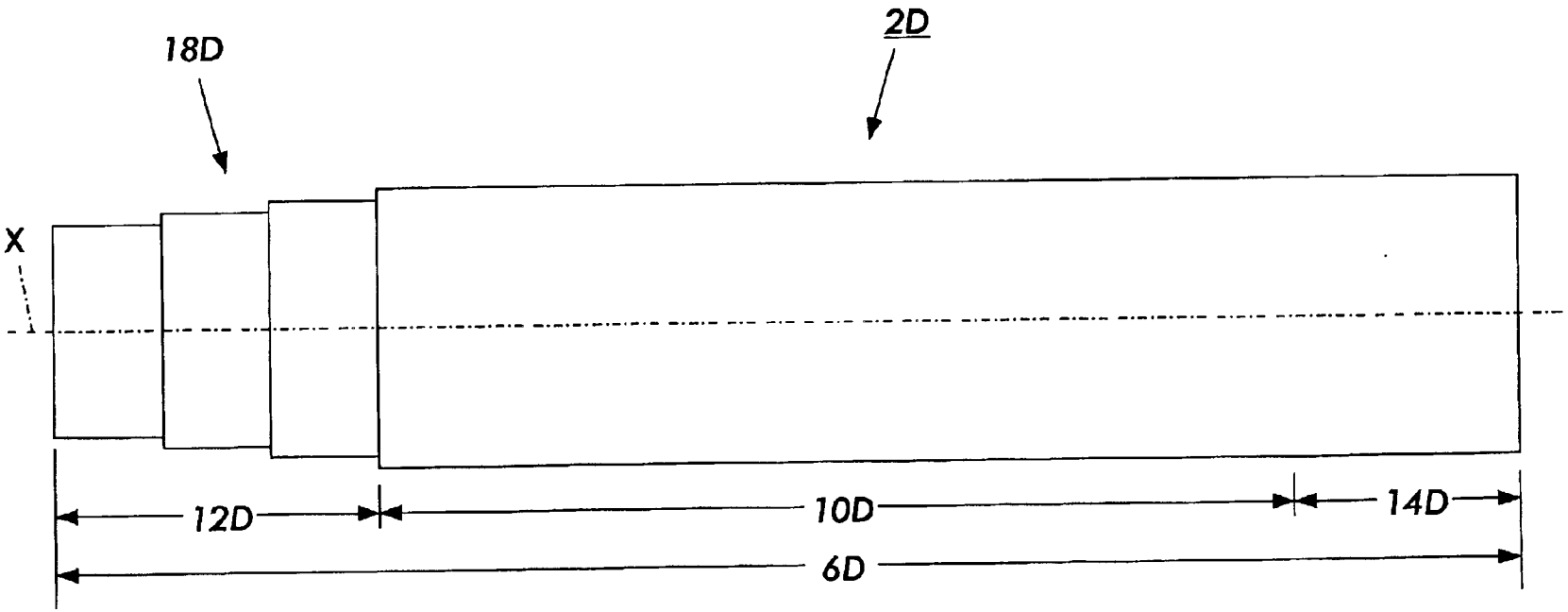
FIG. 4 is an elevational view of a fourth embodiment of the substrate useful in the present invention.
Figure 5:
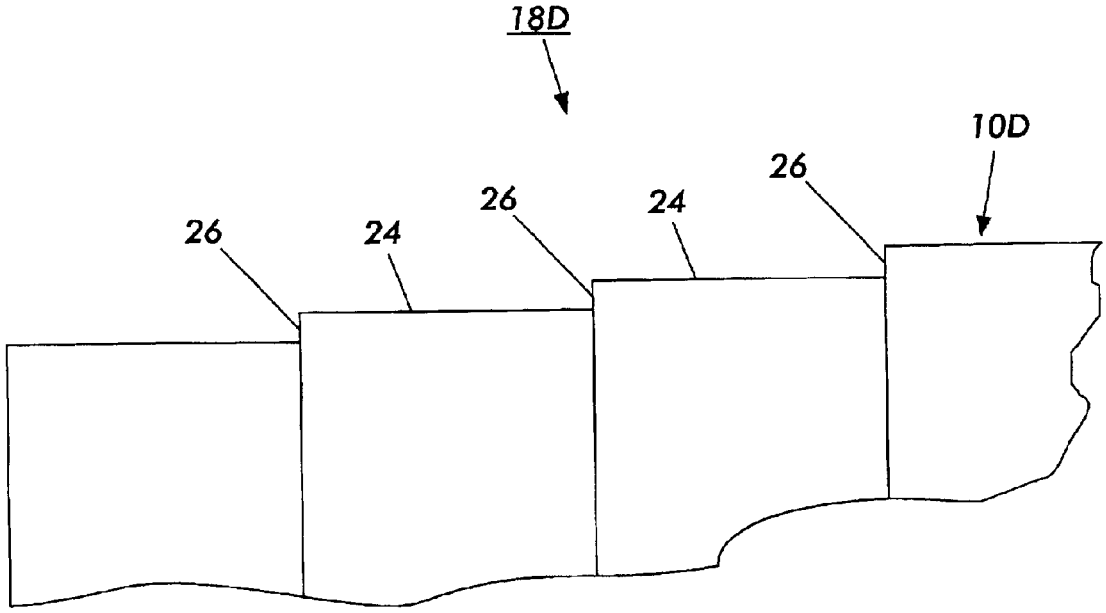
FIG. 5 is a simplified view of a portion of the substrate depicted in FIG. 4.

In FIGS. 4–5, the first recessed surface portion 18D is a stepped area, with generally level surfaces 24 alternating with ledges 26 (generally perpendicular to the longitudinal axis) to form a plurality of steps ranging in number for instance from 2 to 500. The stepped area may be circumferential around the outer dimension of the first end region 12D. The steps can be ascending or descending. The generally level surfaces 24 of the stepped area each has a length ranging for instance from about 5 micrometers to about 20 mm; the ledges 26 of the stepped area each has a height ranging for example from about 5 micrometers to about 500 micrometers, particularly about one-half the substrate wall thickness. In FIG. 4, the uncoated region is absent and the second recessed surface portion is also absent.

In the Figures, the first recessed surface portion (18A, 18B, 18C, 18D) and the second recessed surface portion (20A, 20B, 20C) are depicted as being recessed below the level intermediate region. The first recessed surface portion may occupy a part of or all of the first end region. The second recessed surface portion may occupy a part of or all of the second end region. In embodiments, each section of the first end region has a surface height that is the same as the intermediate region, that is lower than the intermediate region or that is insignificantly higher than the intermediate region. In embodiments, each section of the second end region has a surface height that is the same as the intermediate region, that is lower than the intermediate region or that is insignificantly higher than the intermediate region. The phrase "insignificantly higher" refers to a difference of less than about 1% where the intermediate region is the baseline for comparison.

To increase the surface area, any suitable recessed surface portion may be employed in the first end region and the second end region. Besides the embodiments of the recessed surface portion depicted in the Figures, other embodiments can be used including facets (such as those found in diamonds), helical, longitudinally grooved, knurled diamond pattern, and the like. The first end region and the second end region each may include different types of recessed surface portions.

The first recessed surface portion and the second recessed surface portion may be formed by any suitable method including for instance by machining the substrate with a diamond tipped tool.

The surface area of the first end region is greater than the surface area of the hypothetical level first end region by an amount ranging for example from about 0.2% to about 20%, including from about 1% to about 10%, and especially from about 4% to about 5%.

Where the second end region optionally includes the second recessed surface portion, the surface area of the second end region is greater than the surface area of the hypothetical level second end region by an amount ranging for example from about 0.2% to about 20%, including from about 1% to about 10%, and especially from about 4% to about 5%.

The term "level" indicates that the particular surface at issue is generally smooth (when viewed by an observer without magnification equipment) and is parallel to the longitudinal axis (i.e., without any recessed surface portion).

To illustrate the meaning of hypothetical level first end region and hypothetical level second end region, the substrate in embodiments may be for example a right circular cylinder, where there is absent any recessed surface portion in the substrate's two end regions.

In embodiments, the increase in surface area due to the presence of the recessed surface portions may be approximated by calculating the surface area of the ledge or ledges in the recessed surface portion. In embodiments, a ledge is a surface that is generally perpendicular to the longitudinal axis (i.e., forming an angle ranging for instance from about 80 to about 100 degrees, and particularly about 90 degrees). As shown in the examples herein the increase in the surface area due to the presence of the recessed surface portion is much greater than the loss in surface area due to the decrease in substrate diameter due to the recessed diameter of the recessed surface portion.

In embodiments, the portions of the dip coated layer over the first end region and the second end region are substantially level. The phrase "substantially level" means that the variation in surface profile is less than about 10% between the highest and lowest points on the surface of the dip coated layer portion based on the nominal thickness of the dip coated layer. In embodiments, the variation in surface profile may be for example plus/minus less than about 4 micrometers, particularly plus/minus about 2 micrometers. In the absence of the recessed surface portion, under similar coating situations, the variation in surface profile between the highest and lowest points on the surface of the dip coated layer portion may range for instance from about 30% to about 50% based on the nominal thickness of the dip coated layer, a significantly greater variation in surface profile.

In the case with photoreceptors, since optimal copy quality is achieved, in part, through uniform photoconductor film thickness, it is desirable to minimize variation in film thickness across the usable coated image area. Increasing the substrate surface area will serve to not only increase film thickness but uniformity as well. In the illustrative example of a recessed surface portion in the form of grooves, the improvement in thickness uniformity is further enhanced by the volume displacement of the grooves. As the volume displacement to ledge surface area increases so too does the coating replenishment capability due to the solution retaining substrate grooves. Deeper grooves, so to speak, will continue to replenish the dip coated layer as it is withdrawn from the coating solution until "skinning" and ultimately congealing ceases further thickness change. This effect can be controlled or mitigated through the intrinsic properties of the coating solution, in particular, specific gravity and viscosity in addition to the more typical control parameter of withdrawal velocity.

The phrase "dip coating" encompasses the following techniques to deposit layered material onto a substrate: moving the substrate into and out of the coating solution; raising and lowering the coating vessel to contact the coating solution with the substrate; positioning the substrate in a vessel containing the coating solution and then draining the coating solution from the vessel.

The substrate may be moved into and out of the solution at any suitable speed including the takeup speed indicated in Yashiki et al., U.S. Pat. No. 4,610,942, the disclosure of which is hereby totally incorporated by reference. The dipping speed to contact the substrate with the coating solution may range for example from about 50 to about 3,000 mm/min and may be a constant or changing value. The takeup speed to withdraw the substrate from the coating solution may range for example from about 50 to about 500 mm/min and may be a constant or changing value. The viscosity of the coating solution may range for example from about 200 to about 500 centipoise, and particularly from about 300 to about 400 centipoise.

For the deposited layer or layers, each layer has a thickness ranging for example from about 0.1 to about 50 micrometers.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate can vary in thickness over substantially wide ranges depending on its desired use. Generally, the conductive layer ranges in thickness from about 50 Angstroms to about 30 micrometers, although the thickness can be outside of this range. When a flexible electrophotographic imaging member is desired, the substrate thickness typically is from about 0.015 mm to about 0.15 mm. The substrate can be fabricated from any other conventional material, including organic and inorganic materials. Typical substrate materials include insulating non-conducting materials such as various resins known for this purpose including polycarbonates, polyamides, polyurethanes, paper, glass, plastic, polyesters such as MYLAR® (available from DuPont) or MELINEX® 447 (available from ICI Americas, Inc.), and the like. If desired, a conductive substrate can be coated onto an insulating material. In addition, the substrate can comprise a metallized plastic, such as titanized or aluminized MYLAR®. The substrate can be flexible or rigid, and can have any number of configurations such as a cylindrical drum, an endless flexible belt, and the like.

The substrate and coating solution are described herein as being used in the fabrication of a photoreceptor. However, the present invention is not limited to the fabrication of a photoreceptor. In embodiments, the present invention uses other substrates and coating solutions not specifically described herein which are useful for other applications.

Any suitable coating solution can be used to form the layer or layers deposited over the substrate. In embodiments, the coating solution may comprise materials typically used for any layer of a photoreceptor including such layers as a charge barrier layer, an adhesive layer, a charge transport layer, and a charge generating layer, such materials and amounts thereof being illustrated for instance in U.S. Pat. Nos. 4,265,990, 4,390,611, 4,551,404, 4,588,667, 4,596,754, and 4,797,337, the disclosures of which are totally incorporated by reference.

In embodiments, a coating solution may include the materials for a charge barrier layer including for example polymers such as polyvinylbutyral, epoxy resins, polyesters, polysiloxanes, polyamides, or polyurethanes. Materials for the charge barrier layer are disclosed in U.S. Pat. Nos. 5,244,762 and 4,988,597, the disclosures of which are totally incorporated by reference.

The optional adhesive layer preferably has a dry thickness between about 0.001 micrometer to about 0.2 micrometer. A typical adhesive layer includes film-forming polymers such as polyester, du Pont 49,000 resin (available from E. I. du Pont de Nemours & Co.). VITEL-PE100™ (available from Goodyear Rubber & Tire Co.), polyvinylbutyral, polyvinylpyrrolidone, polyurethane, polymethyl methacrylate, and the like. In embodiments, the same material can function as an adhesive layer and as a charge blocking layer.

In embodiments, a charge generating solution may be formed by dispersing a charge generating material selected from azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. A representative charge generating solution comprises: 2% by weight hydroxy gallium phthalocyanine; 1% by weight terpolymer of vinyl acetate, vinyl chloride, and maleic acid; and 97% by weight cyclohexanone.

In embodiments, a charge transport solution may be formed by dissolving a charge transport material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like. An illustrative charge transport solution has the following composition: 10% by weight N,N'-diphenyl-N,N'-bis(3-methylphenyl)-(1,1'-biphenyl)-4,4'diamine; 14% by weight poly(4,4'-diphenyl-1,1'-cyclohexane carbonate) (400 molecular weight); 57% by weight tetrahydrofuran; and 19% by weight monochlorobenzene.

A coating solution may also contain a solvent, preferably an organic solvent, such as one or more of the following: tetrahydrofuran, monochlorobenzene, and cyclohexanone.

After all the desired layers are coated onto the substrate, the coated layers may be subjected to elevated drying temperatures such as from about 100 to about 160° C. for about 0.2 to about 2 hours.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

EXAMPLE 1

An about 84 mm diameter aluminum cylindrical substrate with a wall thickness of about 1 mm was lathed to a mirror surface. In the lathing process the two substrate end regions were machined in a stepwise fashion (similar to the recessed surface portion of FIG. 4 but with different number of ledges) producing in each end region four ledges which were at about 5 mm intervals and successively about 0.1 mm less in diameter than the center of the substrate. Each ledge had a height of about 50 micrometers. Each ledge had a surface area of about 13.2 sq mm. Each about 5 mm interval was reduced in surface area (successively) by about 0.157 sq mm. Each end region (of 4 ledges) had a net total increase in area of about 51.2 sq mm compared to a hypothetical level end region without the ledges. The subsequent increase in surface area due to the ledges enabled the retention of coating solution to provide an improved final film thickness uniformity over the intermediate region of the substrate.

EXAMPLE 2

An about 84 mm diameter aluminum cylindrical substrate with a wall thickness of about 1 mm was lathed to a mirror surface. In the lathing process the two substrate end regions were machined such that there were three grooves about 0.5 mm deep and about 0.5 mm in width at each end region (similar to the recessed surface portions of FIG. 1 but with a different number of grooves). The grooves were uniformity spaced such that the innermost groove in each end region was about 19.5 mm from the end of the substrate. The increase in surface area per groove was about 262.3 sq mm. Each 0.5 mm interval was reduced in surface area by about 1.57 sq mm due to the presence of the grooves. Each end region (of 3 grooves) had a net total increase in surface area of about 782.2 sq mm compared to a hypothetical level end region without the grooves. The three grooves at the top end region (as the substrate is coated vertically) provided a retention volume of coating solution which replenished the depleting wet film to achieve uniform film thickness across the intermediate region of the substrate. Further adjustments may be made to the coating solution viscosity, specific gravity and coating withdrawal velocity to further optimize thickness uniformity.

Other modifications of the present invention may occur to those skilled in the art based upon a reading of the present disclosure and these modifications are intended to be included within the scope of the present invention.

We claim:

1. A coating method for a photoreceptor comprising:

(a) providing a single piece substrate including a deposition region and an optional uncoated region, wherein the deposition region includes a level intermediate region disposed between a first end region and a second end region, wherein the first end region includes a first recessed surface portion which is a feature of the single piece substrate that increases the surface area of the first end region, wherein the first recessed surface portion is recessed below the level intermediate region;

(b) dip coating a layer of a coating solution over the first end region, the intermediate region, and the second end region in the recited sequence wherein the dip coated layer comprises materials for a photoreceptor layer; and (c) drying the dip coated layer to result in the photoreceptor layer, wherein the photoreceptor layer is part of the photoreceptor.

2. The method of claim 1, wherein the substrate is a cylinder.

3. The method of claim 1, wherein the first recessed surface portion includes at least one groove.

4. The method of claim 1, wherein the first recessed surface portion includes a tapered surface.

5. The method of claim 1, wherein the first recessed surface portion includes a stepped area.

6. The method of claim 1, wherein the dip coated layer comprises a charge transport material.

7. The method of claim 1, wherein the portion of the dip coated layer over the first end region is substantially level.

* * * * *